US005404975A

United States Patent [19]

Michel

[11] Patent Number: 5,404,975

[45] Date of Patent: Apr. 11, 1995

[54] SELF-LOCKING ADJUSTMENT DRIVE

[75] Inventor: Peter Michel, Kleinrinderfeld, Germany

[73] Assignee: Siemens Aktiengesellschaft, München, Germany

[21] Appl. No.: 63,386

[22] Filed: May 18, 1993

[30] Foreign Application Priority Data

May 20, 1992 [EP] European Pat. Off. ..... 92108541

[51] Int. Cl.[6] ..... E05F 11/50

[52] U.S. Cl. ..... 192/7; 74/425; 188/82.77

[58] Field of Search ..... 192/7, 8 R, 8 A; 74/425; 188/82.7, 82.77; 49/349

[56] References Cited

U.S. PATENT DOCUMENTS

| | | | |
|---|---|---|---|
| 2,339,232 | 1/1944 | Moroney | 192/8 R |
| 2,918,275 | 12/1959 | Arlauskas | 192/8 R X |
| 3,757,472 | 9/1973 | Rogakos | 192/8 R X |
| 3,976,172 | 8/1976 | F'Geppert | 192/8 R |
| 4,899,608 | 2/1990 | Knappe et al. | 49/349 X |
| 5,040,430 | 8/1991 | Adam et al. | 49/349 X |

FOREIGN PATENT DOCUMENTS

| | | | |
|---|---|---|---|
| 0478931 | 4/1992 | European Pat. Off. . | |
| 2911024 | 9/1980 | Germany . | |
| 214447 | 4/1924 | United Kingdom | 188/82.77 |

*Primary Examiner*—Rodney H. Bonck
*Attorney, Agent, or Firm*—Kenyon & Kenyon

[57] ABSTRACT

A compact and quiet-operating motor vehicle window drive has the following features: a first drive element or worm gear drives an entraining element with tangential play; a toothed rim is provided in a gear drive housing, axially concentric with the entraining element; a detent pawl that can engage the toothed rim in a self-locking pivot position is mounted in the manner of a toggle lever in the entraining element; a friction ring, with a first disengagement cam in front of and a second detent pawl cam behind the detent pawl, is mounted frictionally and rotatably in the gear drive housing in such a way that when motor drive occurs in "raise" mode, the friction ring is moved by the entraining element by means of the detent pawl which contacts the first disengagement cam and when motor drive occurs in "lower" mode, the friction ring is moved directly by the first drive element (worm gear); and when the entraining element is driven from the output side in the "lowering" rotation direction, the detent pawl can be engaged in a self-locking manner in the toothed rim by means of the second detent pawl cam.

9 Claims, 3 Drawing Sheets

SELF-LOCKING ADJUSTMENT DRIVE

BACKGROUND OF THE INVENTION (i) Technical Field

The invention relates generally to adjustment drives, for example a drive apparatus for adjusting windows, sliding roofs, and the like of motor vehicles.

(ii) Background Information

German patent document DE-A1 29 11 024 discloses a motor vehicle window drive apparatus having a ratchet-type locking mechanism. A pivoting detent pawl mounted on an entraining element is biased under spring pressure toward a toothed rim. When a motor used to drive the mechanism is in operation, the detent pawl is free to move relative to the toothed rim. In one direction to raise the window, the detent pawl slides over the teeth of the toothed rim without locking, and in the opposite direction to lower the window, a stop cam acts against the spring pressure on the detent pawl to disengage it from the toothed rim. When the motor is not in operation, the detent pawl engages the toothed rim to prevent unwanted movement. Tangential play between the entraining element and a motor-driven worm gear is possible only in the context of elastic resilience of a damping element interposed between the worm gear and the entraining element.

SUMMARY OF THE INVENTION

An object of the present invention is to provide an improved adjustment drive mechanism that can be fixed by positive self-locking, with reduced noise in operation.

In the adjustment drive according to the present invention, detent pawls are entirely released from a toothed rim when the mechanism is in operation. Thus, the detent pawls do not slide over the teeth of the toothed rim, and undesirable noise is avoided.

The adjustment drive of the present invention comprises detent pawls which, when the motor of the drive is not in operation, are fixed positively in a toothed rim as a result of their toggle lever effect, thereby providing self-locking. The detent pawls are brought into engagement with the toothed rim by relative movement between an entraining element and a friction ring. During operation of the motor, the detent pawls are entirely released from the toothed rim by a friction ring. The present invention dispenses with the need for springs, which are subject to undesirable aging.

DESCRIPTION OF A PREFERRED EMBODIMENT

Figure 1:
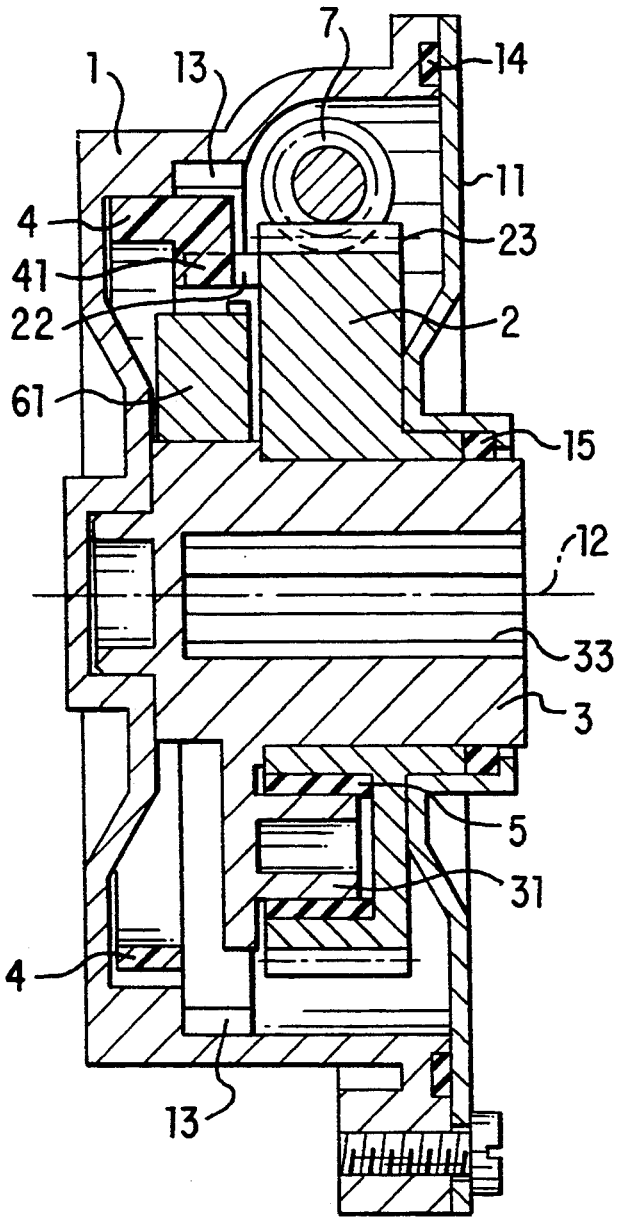
FIG. 1 shows an adjustment drive apparatus in axial cross-section taken along the line I—I in FIG. 3.

The adjustment drive mechanism shown in FIG. 1 comprises a cup-shaped gear drive housing 1 in which is located a first drive element or worm gear 2 and entraining element 3. Outer teeth 23 of the worm gear 2 mesh with a worm gear shaft 7 that is part of a rotor shaft, extending into gear drive housing 1, of a commutator motor (not pictured) flanged onto gear drive housing 1. Gear drive housing 1 is closed off on its open side by a gear drive housing cover 11. The gear drive housing cover 11 is sealed with respect to the top edge of the gear drive housing 1 by a sealing ring 14.

Worm gear 2 is connected in a tangential, elastic, rotationally entrained manner, with a damping element 5 interposed, to the entraining element 3. Damping element 5 serves to provide tangentially elastic, resilient, and therefore shock-damping entrainment between worm gear 2 and entraining element 3. Both worm gear 2 and entraining element 3 are mounted rotatably about a gear drive axis 12.

Entraining element 3 has an internal pinion drive shaft 33 that extends as an output shaft through the worm gear 2 and through a hole in gear drive housing cover 11. The gear drive housing cover 11 is sealed with respect to the outer periphery of the internal pinion drive shaft 33 by a sealing ring 15.

Figure 2:
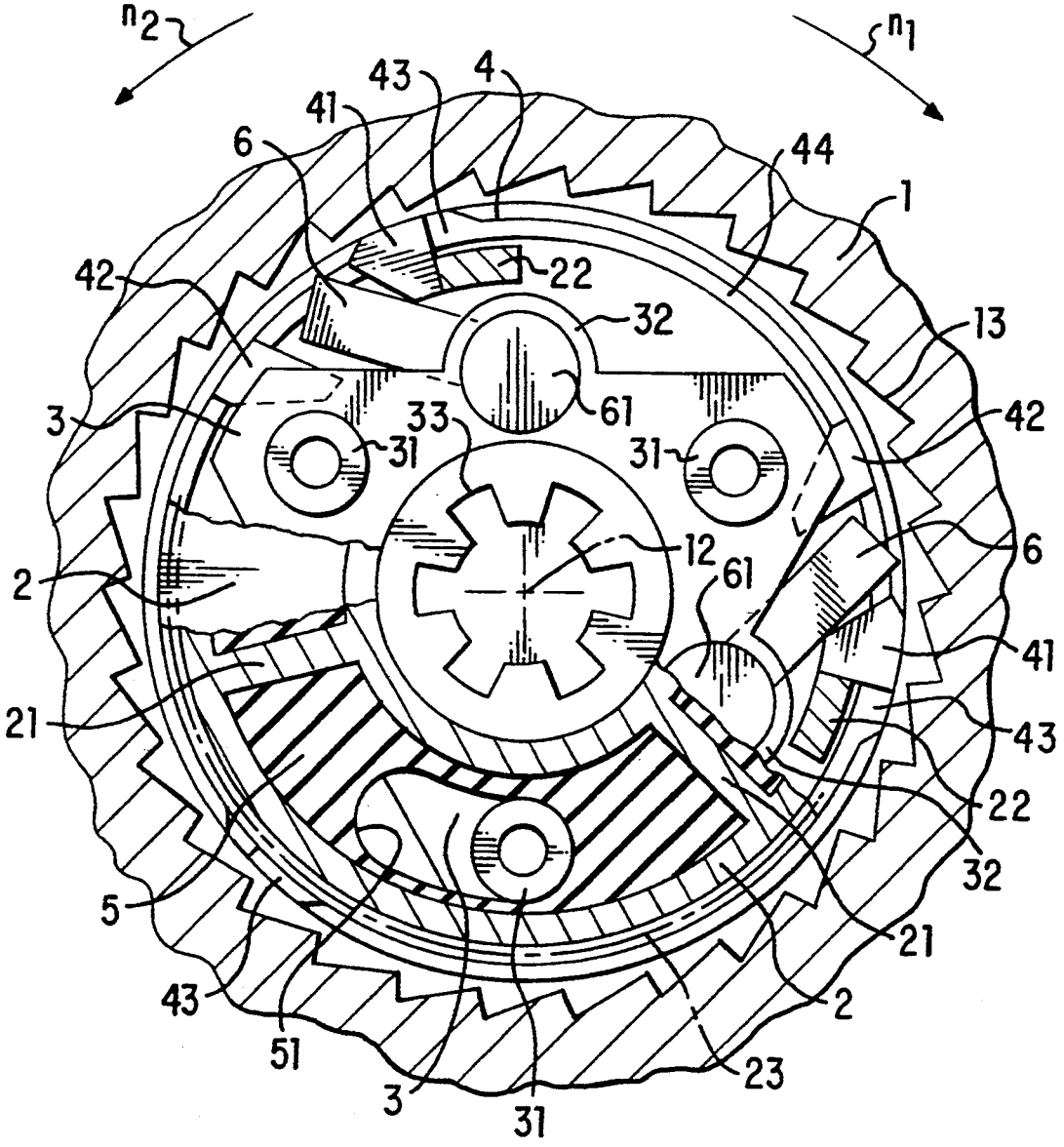
FIG. 2 shows an axial output-side top view (partly sectioned) of the adjustment drive apparatus of FIG. 1, with detent pawls in a disengaged position.

Worm gear 2, preferably injection-molded from plastic, engages radial grooves of damping element 5 by integral radial entrainment webs 21 distributed over its periphery, as shown in FIG. 2. Tangential elongated entraining element holes 51 are located in the damping element 5. Entraining element 3, also preferably injection-molded from plastic, has integral radial entrainment cams 31 around its periphery which engage the elongated holes 51 of the damping element 5. The entrainment cams 31 engage elongated holes 51 in such a way that the tangential length of the elongated holes 51 makes possible a tangential play in the rotary entrainment between worm gear 2 and entraining element 3. Such tangential play is over and above the tangential play due to the resilience of damping element 5.

As shown in FIG. 2, recesses in the form of a toothed rim 13 with a sawtooth profile are provided on the inner periphery of the gear drive housing 1, concentric with gear drive axis 12. A plastic friction ring 4 is mounted axially below toothed rim 13 such that it contacts the frictional surface of gear drive housing 1. The friction ring 4 engages the frictional surface of gear drive housing 1 at contact shoulders 43. Spring webs 44 which connect contact shoulders 43 are preloaded so that when friction ring 4 is installed, it is pressed radially against the frictional surface of gear drive housing 1.

Detent pawls 6 having bearing pins 61 are pivotably mounted in detent pawl bearing receptacles 32 of entraining element 3. The detent pawls 6 are mounted in the manner of a toggle lever, wherein a first line extending through the radial end point of the free end of a detent pawl 6 and the pivot point of the detent pawl 6 and a second line extending through the gear drive axis 12 and the pivot point of the detent pawl 6 form an obtuse angle with each other. Thus, as is described below, forces from the toothed rim 13 upon the detent pawls 6 cause the detent pawls 6 to self-lock.

Friction ring 4 has a first disengagement cam 41, located adjacent contact shoulder 43, and a second detent pawl cam 42. The first disengagement cam 41 and second detent pawl cam 42 can be injection molded as a single unit with plastic friction ring 4. Viewed in rotational direction $n_1$, the direction of rotation for raising the window, the first disengagement cam 41 is located in front of detent pawl 6 and the second detent pawl cam 42 is located behind the detent pawl 6. An axial stop cam 22 of worm gear 2 projects in the region in front of the first disengagement cam 41.

When the motor is operated to raise the window, worm gear 2 is driven via worm gear shaft 7 in the first rotation direction $n_1$. Entrainment webs 21 of worm gear 2 engage damping element 5 for rotation with the worm gear 2. After entrainment cams 31 of entraining element 3 have struck tangentially against the ends of elongated holes 51, the worm gear 2 is in elastically damped rotationally entrained engagement with entraining element 3.

When entraining element 3 is driven by worm gear 2 in the first rotation direction $n_1$, detent pawls 6 come into contact with the first disengagement cams 41 so that they are disengaged from toothed rim 13 as shown in FIG. 2. After such disengagement, the action of the detent pawls 6 against the first disengagement cams 41 causes the friction ring 4 to be carried along with the entraining element 3. In this manner, when motor drive occurs in the first rotation direction $n_1$, torque is transferred from worm gear shaft 7 to the internal pinion drive shaft 33 with complete disengagement of the detent pawls 6 from the toothed rim 13. Thus, torque is transmitted in a noiseless manner.

When motor drive occurs in the other rotation direction $n_2$, the direction of rotation for lowering the window, damping element 5 is once again initially entrained tangentially by worm gear 2 via entrainment webs 21. However, before entrainment cams 31 of entraining element 3 can strike against the end surfaces of elongated holes 51, stop cam 22 formed axially onto worm gear 2 comes into contact with first disengagement cam 41 of friction ring 4. The stop cam 22 forces movement of the friction ring 4 so that the friction ring 4 is moved through a small tangential angle to ensure disengagement of the detent pawls 6 from the toothed rim 13. Only after this disengagement is entraining element 3 also entrained with contact damping as entrainment cams 31 contact the respective end surfaces of elongated holes 51 of damping element 5. Movement of entraining element 3 in direction $n_2$ serves to rotate internal pinion drive shaft 33 for lowering the window.

Figure 3:
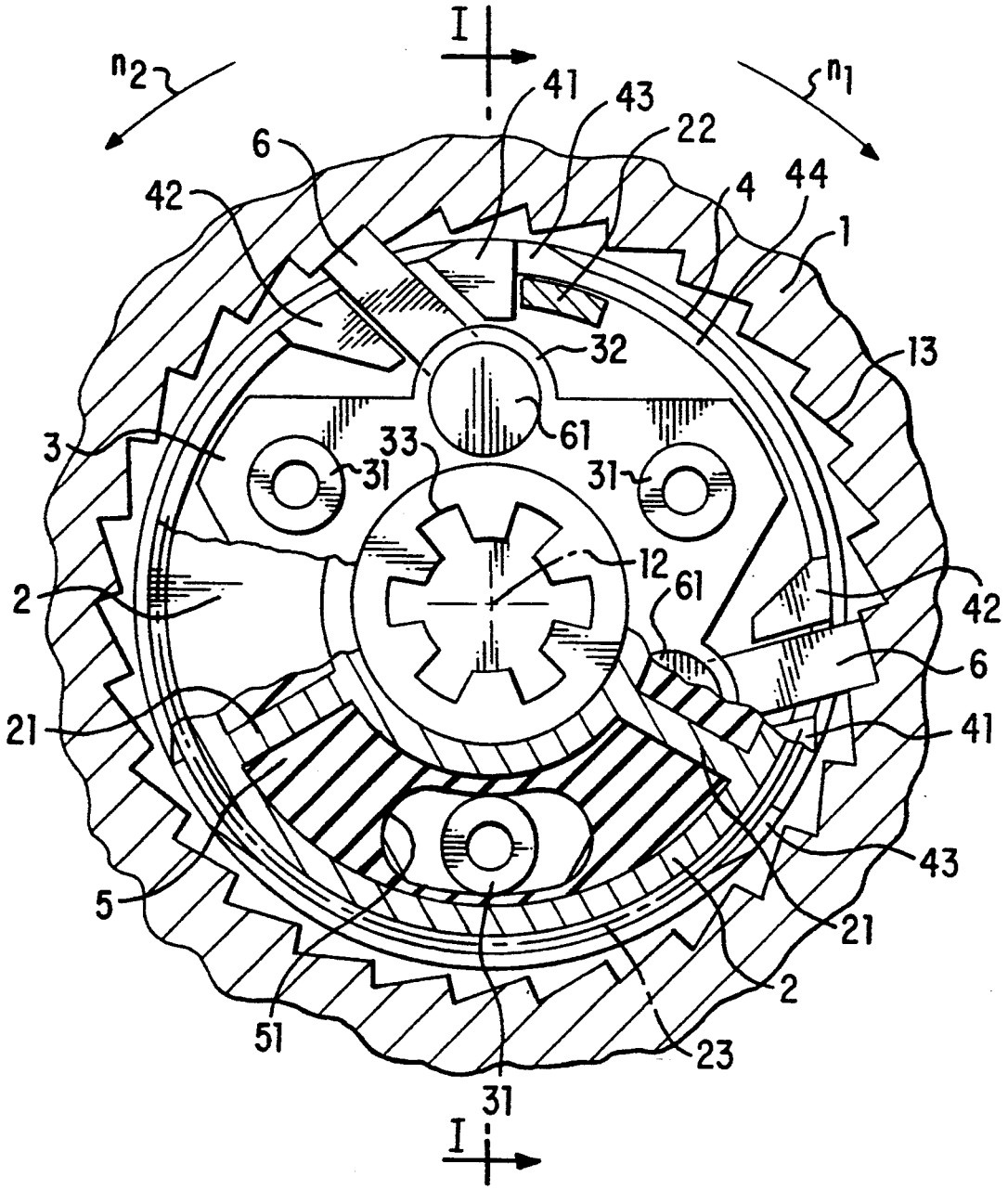
FIG. 3 shows another axial output-side top view (partly sectioned) of the adjustment drive apparatus of FIG. 1, with detent pawls fixed positively in an engaged or self-locking position.

The self-locking feature of the adjustment drive prevents undesired movement. When outside forces, such as vibrations or inadvertent manual pressure on the window, act on the internal pinion drive shaft 33, entraining element 3 is moved relative to worm gear 2 so that the free ends of detent pawls 6, which have previously pivoted free, come into contact with the second detent pawl cams 42 of friction ring 4. Because of the frictional resistance between friction ring 4 and gear drive housing 1 that accommodates it with slight radial pressure, the movement brings detent pawls 6 into engagement with the toothed rim 13, as shown in FIG. 3. Further movement of the entraining element 3 is thereby prevented by the toggle lever action of detent pawls 6 which are fixed in a self-locking manner with toothed rim 13. The load on the second detent pawl cams 42 is thereby relieved.

The frictional resistance between friction ring 4 and gear drive housing 1 is selected so that on the one hand when motor drive occurs it is entrained in one or the other rotation direction $n_1$ or $n_2$ with as little resistance as possible. However, when drive occurs from the output side, sufficient contact resistance with the gear drive housing 1 is provided so that the friction ring 4 does not rotate and detent pawls 6 are pivoted into self-locking engagement with toothed rim 13. Such preloading can be achieved with a friction ring 4 constructed of plastic in contact with the gear drive housing 1 under inherent material and/or shape-related tension.

As is evident from FIGS. 2 and 3, the worm gear 2 entraining element 3, detent pawls 6 and other elements of the adjustment drive including mounts, entrainments, and engagements, are configured in accordance with an axial insertion method.

What is claimed is:

1. An adjustment drive that can be fixed by positive self-locking, wherein the adjustment drive is rotatable in first and second rotation directions, said adjustment drive comprising:

a first drive element in entrained connection, with tangential play, with an axially concentric entraining element;

an output shaft coupled to the entraining element;

recesses forming a toothed rim in a gear drive housing axially concentric with the entraining element;

at least one detent pawl, pivotably mounted in the entraining element in a toggle lever arrangement, wherein the detent pawl can engage the recesses in a self-locking pivot position; and a friction ring, having a first disengagement cam and a second detent pawl cam, with the first disengagement cam located in front of the detent pawl with respect to the first rotation direction and the second detent pawl cam located behind the detent pawl with respect to the first rotation direction, said friction ring mounted frictionally and rotatably in the gear drive housing and axially concentric with the entraining element, in such a way that when a motor drive occurs in the first rotation direction, the friction ring is moved by the entraining element by means of the detent pawl which contacts the first disengagement cam, and when a motor drive occurs in the second rotation direction, the friction ring is moved directly by the first drive element, and when the entraining element is driven from an output side in the second rotation direction, the detent pawl can be engaged positively and in a self-locking manner in the toothed rim by being stopped by the second detent pawl cam.

2. The adjustment drive according to claim 1, wherein the friction ring engages the gear drive housing with frictional resistance such that on the one hand with motor drive it is movable in either the first or the second rotation direction, but when driven from the output side in the second rotation direction, sufficient stop resistance of the second detent pawl cam is provided so as to pivot the detent pawl into its positively self-locking engagement in the toothed rim.

3. The adjustment drive according to claim 2, wherein the friction ring comprises a plastic ring pressing against the gear drive housing under inherent material- or shape-related tension, with first disengagement cams and second detent pawl cams formed integrally.

4. The adjustment drive according to claim 1, wherein the first drive element can be brought, in order to disengage the detent pawl when motor drive occurs in the second rotation direction, into contact with the first disengagement cam of the friction ring by means of stop cams.

5. The adjustment drive according to claim 1, wherein the first drive element is in entrained contact with the entraining element by means of an elastic damping element.

6. The adjustment drive according to claim 5 wherein the elastic damping element is configured so that when motor drive occurs in the second rotation direction, the first drive element engages the entraining element by means of the elastic damping element only after the detent pawl has been disengaged.

7. The adjustment drive according to claim 1, comprising a plurality of detent pawls, first disengagement cams, and second detent pawl cams.

8. The adjustment drive according to claim 1, wherein the first drive element, the entraining element and the detent pawl are assembled by insertion axially with respect to the rotation directions of the drive.

9. The adjustment drive according to claim 1, wherein the first drive element comprises a worm gear.

* * * * *